US005125218A

United States Patent [19]

Smith-Gander et al.

[11] Patent Number: 5,125,218

[45] Date of Patent: Jun. 30, 1992

[54] STORAGE SYSTEM

[75] Inventors: Dwight S. Smith-Gander, Westlock; Calvin D. Mazurenko, Thorhild; Robert M. Smith, Westlock, all of Canada

[73] Assignee: Alberta Ag-Industries Ltd., Westlock, Canada

[21] Appl. No.: 679,555

[22] Filed: Apr. 2, 1991

[30] Foreign Application Priority Data

Jun. 19, 1990 [CA] Canada ..... 2019333

[51] Int. Cl.[5] ..... B65B 43/26; B65B 5/08

[52] U.S. Cl. ..... 53/576; 53/244; 53/255; 53/459; 135/88

[58] Field of Search ..... 53/567, 576, 577, 585, 53/171, 244, 255, 258, 570; 135/87, 88

[56] References Cited

U.S. PATENT DOCUMENTS 4,165,595 8/1979 Pilley et al. ..... 53/567 X
4,309,861 1/1982 Karpisek ..... 53/567 X
4,606,176 8/1986 Cundall ..... 53/576 X
4,686,817 8/1987 Brodrecht et al. ..... 53/576 X
4,829,750 5/1989 Cassidy ..... 53/585 X
5,016,424 5/1991 Stirling ..... 53/567 X

FOREIGN PATENT DOCUMENTS 0111434 6/1984 European Pat. Off. .

*Primary Examiner*—John Sipos
*Assistant Examiner*—Linda B. Johnson
*Attorney, Agent, or Firm*—Riches, McKenzie & Herbert

[57] ABSTRACT

Apparatus for use in combination with a protective flexible tubular material which facilitates the use of tubular material for the temporary storage of palleted goods. The apparatus retains a folded store of tubular material, and rearwardly dispenses a layer of the tubular material from the folded store. The apparatus frame defines an entrance into the tubular material and has a skid plate which facilitates loading of palleted goods within the tubular material. An inexpensive storage system results.

1 Claim, 7 Drawing Sheets

STORAGE SYSTEM

FIELD OF THE INVENTION

This invention is related to an outdoor storage system, and more particularly to an apparatus used to facilitate the storage of items in a large tubular sack.

DESCRIPTION OF THE RELATED ART

In seasonal businesses, and in businesses which generally have a cyclical demand for goods or products, it is desirable that high levels of inventory are on-hand during peak demand periods in order to supply the market with product. Storage facilities for these businesses must be sized so as to store sufficient quantities of product to supply the peak demand period. At other times of the business cycle, however, these storage facilities may be over-sized for the amount of material which must be stored. The expense of providing permanently fixed storage facilities sized to handle the amount of material necessary to handle the peak season adds to the cost of the product to be sold.

While temporary rental facilities may be obtained, the cost of the temporary facilities can be high.

An alternative to the problem of supplying sufficient quantities of goods during peak season is to size production capacity so as to be able to supply the large volumes of product necessary. However, this alternative results in the under-utilization of the production facility during the slower season.

Accordingly, it would be desirable to provide a temporary storage system for goods, which storage system would be less expensive than conventional rental warehouse facilities.

In the agricultural industry, the storage of silage in large tubular bags known as silage bags is common. These silage bags are typically 1.2 to 3.7 meters (4 to 12 feet) or more in diameter and can be up to 76 meters (250 feet) or more in length. Silage is forced, as compacted material, into the bag, or, for example, hay is placed into the bag as round or square bales. Various devices are known for maintaining the bag mouth in an open position so that the bag can be filled.

In one known silage system, the entire bag is initially fitted onto the apparatus. The bag is folded in an accordion fashion, for example, so as to allow the bag to be pulled off the apparatus in a continuous fashion. A first, or beginning, portion of the bag is rearwardly removed from the apparatus and the end of the tubular material is sealed, or tied, together in order to form one end of a bag or sack. The silage to be stored is fed through an opening in the apparatus into the inside of the first portion of the bag. As the first portion of the bag is filled, the apparatus is moved in a forward direction, and a subsequent portion of the tubular material is allowed to slip off the apparatus in a rearward direction. As the subsequent portion of the bag is filled, the apparatus is again moved so as to provide another subsequent portion of the bag which can be filled. This operation is continued until essentially the entire length of the bag is filled with silage. The remaining end of the bag is removed from the apparatus, and sealed or tied together. The filled silage bag is left where it has been filled, and can be opened whenever silage is required.

The length of bag material allowed to fall off the apparatus is approximately equal to the distance that the apparatus has moved forward.

One known method for providing a silage storage system for storing pressed vegetable material, or silage, is described in European Patent No. 0,111,434 (Korsgaard), which also mentions that the silage storage method and apparatus described therein may be used for palleted goods of any kind. While Korsgaard states that palleted goods may be stored in the apparatus of his invention, the apparatus described therein is largely unsuitable for the storage of palleted goods due to the circular funnel shaped apparatus described, which is adapted to receive circular bales of hay.

Further, during loading of the prior art silage bags, it is necessary to provide a means for supporting the bales of hay in front of the bale carrying machine to allow the bale to be placed inside the bag without driving the machine onto the frame.

The bale loading machine is not driven into the silage bag since it may damage the folded store of flexible material that the machine drives over. Further, since the upper support portion of the apparatus used, on which the store of flexible material is supported, is only about 0.5 meter wide, the flexible material that hangs from the upper support falls from the support and interferences with loading machine.

Special machines and devices have been made to provide the extended reach necessary to load the bale into the silage bag.

The arrangement of having an extended reach on the silage bag loading machine can also be used with palleted goods on a conventional fork-lift. During filling, the pallet must be placed on the tines at a distance away from the wheels of the fork-lift so that the pallet can be dropped completely within the sack without driving the fork-lift onto or within the apparatus frame. On most standard fork-lifts, this arrangement results in a space between the pallet and the fork-lift frame approximately equal to the width of the apparatus frame. However, filling of the tubular material in this manner may be hazardous because the weight of the pallet on the fork-lift tines, combined with the space left between the fork-lift frame and the pallet, can lead to instability of the fork-lift and/or the load to be carried.

SUMMARY OF THE INVENTION

We have now found an improved storage system for the temporary storage of goods, and particularly goods on pallets, can be provided by using an apparatus according to the present invention as described hereinbelow.

It is an object of the present invention to provide an apparatus suited to be used in a method of storing goods within a long tubular sack.

It is still a further object of the present invention to provide a method of providing temporary storage of goods within a protective tubular sack.

Accordingly, the present invention provides in its broadest aspect an apparatus of use in a method of loading goods to be stored within a protective sack made of a flexible tubular material, which apparatus comprises:

a frame defining an entrance, comprising a horizontal entrance member, support means for holding said entrance member essentially perpendicular to the ground, and retaining means by which said frame is adapted to retain a folded store of said flexible tubular material during storage operation, whereby said tubular material encircles said frame, and such that, in operation, a portion of said tubular material is rearwardly dispensable from said frame;

an upper support frame located adjacent said entrance member for supporting, in operation, a portion of said folded store of said flexible material, which support frame extends essentially across said entrance and rearwardly from a front edge of said entrance member for at least 1.5 meters; and wherein said frame is adapted to receive a skid plate positionable at the bottom of said frame and extending essentially across the lower portion of said entrance and having a rearward edge adjacent the rear of said entrance, which rearward edge is proximate to the ground, and which skid plate covers a portion of said folded store of said flexible tubular material.

The apparatus defined hereinabove is of use in providing a suitable storage system. A preferred apparatus is further of use in allowing a fork-lift truck to enter inside the bag.

Accordingly, the invention provides in a preferred aspect an apparatus comprising a frame defining an entrance, comprising a horizontal entrance member, support means for holding said entrance member essentially perpendicular to the ground, and retaining means by which said frame is adapted to retain a folded store of said flexible tubular material during storage operation, whereby said tubular material encircles said frame, and such that, in operation, a portion of said tubular material is rearwardly dispensable from said frame;

an upper support frame located adjacent said entrance member for supporting, in operation, a portion of said folded store of said flexible material, which support frame extends essentially across said entrance and rearwardly from a front edge of said entrance member for at least 1.5 meters; and wherein said frame is adapted to receive a skid plate positionable at the bottom of said frame and extend essentially across the lower portion of said entrance and having a forward edge adjacent the front of said entrance, and a rearward edge adjacent the rear of said entrance, which forward edge and rearward edge are both proximate to the ground, and which skid plate covers a portion of said folded store of said flexible tubular material.

The preferred skid plate allows a fork-lift truck to drive into the protective sack formed by the tubular material; and as the tubular material is fed, step wise, off the frame. By having the forward edge and the rearward edge of the skid plate proximate to the ground and adjacent the front and rear of the entrance, respectively, the skid plate acts as a ramp for the fork-lift to drive on when it enters the sack. Proximate in this specification means that the forward and rearward edges are sufficiently close to the ground to enable a wheeled vehicle to drive up onto, or drive off the skid plate without causing an undesirable disturbance of the goods carried by the wheeled vehicle The skid plate can be a steel plate welded to the frame, but can also be a rubber mat which is laid over the lower portion of the store of flexible material during filling of the sack, and which mat can be removed to facilitate loading of the flexible material onto the frame.

Accordingly, the skid plate's primary function is to provide a protective cover for the store of flexible material, which cover reduces or eliminates any damage to the flexible material, over which a wheeled vehicle can drive to enter and exit the tubular sack formed.

The upper portion of the store of tubular material rests on the upper support frame. By extending the frame into the sack by at least 1.5 meters, and preferably 2 meters, a wheeled vehicle, such as for example, a fork-lift truck, is able to drive into the sack without interference from the upper portion of the tubular material. Further, since the tubular material is held up out of the way of the fork-lift, the upper support frame facilitates stacking of palleted goods on top of one another.

As an additional advantage of the present invention, it is unnecessary to leave a gap between the fork-lift frame and the goods being carried. Thus, the fork-lift is more stable in use.

Increasing the length that the upper support frame extends into the protective sack increases the amount of open area in the sack available for loading of the material to be stored in the sack available for loading of the material to be stored in the sack before movement of the frame becomes necessary. Thus, the sack can be filled more rapidly since movement of the time spent moving the frame is reduced. However, the upper support frame must not extend so far into the sack as to cause instability of the frame during use.

While any suitably sized material may be stored in the protective sack, the storage of palleted materials is a preferred feature of the present invention. Accordingly, it is desirable, albeit non-essential, that the entrance member of the apparatus define an entrance which is essentially rectangular.

Although the shape of the frame may be fixed, in a preferred embodiment the sides or the top and bottom of the frame may be extended by a telescopic means so that the height or width of the frame can be adjusted. In this manner, the dimensions of the opening can be adjusted so as to provide a suitable shape for the size and shape of goods to be stored. For example, the opening can be made wide while being low to allow a three pallet wide and one pallet high arrangement. Alternatively, the opening can be made high but narrow to allow one pallet wide and three pallet high arrangements. Other arrangements are also possible.

Accordingly, the present invention also provides an apparatus as hereinbefore defined wherein the frame is provided with telescopic means so that the height and width of the frame can be adjusted.

The tubular material is loaded onto the apparatus in a manner known within the agricultural prior art. The means for retaining the folded store of tubular material may be a solid plate which extends around the outside of the apparatus and which is large enough to hold the folded store of tubular material. However, in order to reduce the weight of the apparatus, it is preferred that the means for retaining the folded store of a tubular material is a plurality of tines, which tines are essentially perpendicular to said frame. The tines on the side of the frame preferably extend away from the forward edge of the frame for a sufficient distance, such as for example, 0.5 to 1 meter, to provide a suitable area to support the concentrated store of tubular material.

The apparatus may be caused to move by providing wheels on the bottom of the apparatus. However, this arrangement also preferably has a braking means attached to the apparatus so that the apparatus would be held in place during filling of the sack.

Preferably the apparatus rests on the ground and is moved by using a fork-lift to lift and move the frame forward, thus causing additional tubular material to be released from the store of flexible material.

The apparatus of the present invention eliminates the need for the special loading machines and devices of the prior art, and eliminates the need for any space between the pallet and the fork-lift frame since the fork-lift can be driven inside of the tubular sack and the goods to be stored can be positioned directly in place.

The tubular material of use on the apparatus of the present invention may be any suitably flexible material which will withstand the environment in which the tubular material is to be stored. For example, the tubular material may be a canvas tarpaulin, but, is preferably the tubular plastic film comprises a polyethylene based resin. The tubular material preferably has a diameter of greater than 1.2 meters (4 feet) and more preferably has a diameter of about 3.7 meters (12 feet).

In a more preferred aspect the invention provides an apparatus of use in a method of loading goods on a pallet to be stored within a protective sack made of a flexible tubular material by means of a fork-lift truck which apparatus comprises:

a rectangular frame defining an entrance, which frame comprising a horizontal entrance member having a first end and a second end;

vertical support means at each of said first and second ends for holding said entrance member essentially perpendicular to the ground;

a base co-operating with said support means to provide stability to said frame;

a biangular skid plate above and extending across said base;

said support means comprising a hollow member and a rigid member in telescopic engagement therewith to allow of relative vertical movement of said rigid member within said hollow member;

jacking means cooperable with said support means to effect said vertical movement of said rigid member within said hollow member;

a plurality of horizontal tines between said first and second ends and extending rearwardly of said entrance and of a length to operably support a folded store of said tubular material and hold a sufficient length of rearwardly dispensed material open and navigatable to said fork-lift truck to enable entry of said truck within a latter part of said dispensed material; and a biangular skid plate above and extending essential across said base and said frame at a lower part, and having a forward edge adjacent the front of said entrance and a rearward edge adjacent the rear of said entrance, which forward and rearward edges are both proximate to the ground, and which skid plate operably covers a portion of said folded store of said flexible material.

In a further aspect, the present invention also provides a method of storing materials in a protective tubular sack comprising:

a) loading a concentrated store of a tubular material onto an apparatus according to the present invention as described hereinabove;

b) removing rearwardly a first portion of said tubular material from said frame;

c) placing an amount of the materials to be stored within said first portion;

d) moving said apparatus forward so as to cause a subsequent portion of said tubular material to be removed from said frame;

e) placing a subsequent amount of the materials to be stored within said subsequent portion; and f) repeating steps d) and e) until said protective tubular sack is essentially filled.

In a still further aspect, the present invention also provides a storage system for the temporary storage of goods comprising an apparatus according to the present invention as described hereinabove when used in combination with a protective tubular material.

It will be clearly understood, that the number of pallets that may be stored within any one storage sack will be dependent on the dimensions of the pallet, the goods to be stored, and on the dimensions of the sack itself. The sack provides a weatherproof protective cover which allows the stored goods to be kept outside, thus eliminating the need for inside warehouse space. Depending on the nature of the protective tubular material, the stored goods may be kept in this fashion for a number of years.

In an alternative apparatus according to the invention, the apparatus comprises one or a plurality of movable plates flexibly attached to said skid plate which movable plate can be moved, or lowered, so as to cause a rearward edge of said movable plate to rest essentially on said tubular material.

The pallets to be placed within the tubular material may then be inserted into the bag so that one edge of the pallet rests on the tubular material, and the opposite edge of the pallet rests on the movable plate. When the apparatus is moved forward, the pallet slips off of the movable plate, and slides into position inside of the sack. In this manner, the pallet can be loaded onto the fork-lift closer to the fork-lift frame than in an arrangement without the movable plate since it is no longer necessary to drop the filled pallet completely within the tubular material.

The movable plate is thus located inside of the bag to be filled and rests on the tubular material, which tubular material rests on the ground. Thus, the lower edge of the movable plate is supported by the ground.

The movable plate may be a single piece, but is preferably a plurality of adjacent plates, which plates can be moved separately.

The movable plate may also be moved, or lifted, to allow easier access to the area under the skid plate and thus allow easier access to the lower part of the frame when the tubular material is being loaded onto the frame. Preferably, the movable plate is attached to said skid plate by a hinge.

As the apparatus is moved forward, the lower edge of the movable plate slides along the lower part of the tubular material. In order to reduce the possibility of tearing of the tubular material, the lower edge of the movable plate is preferably fitted with one or a plurality of rollers so that said rollers rest on said tubular material, and are caused to rotate as said apparatus is moved forward.

BRIEF DESCRIPTION OF THE DRAWINGS

Preferred embodiments of the present invention will now be described, by way of example only, with reference to the attached drawings wherein:

FIG. 1 shows an apparatus 10 comprising a generally rectangular frame 11 having a horizontal entrance member 12 and side portions 13. Side portions 13 each comprises two parts 13A and 13B. Side portion 13B fits into the top of hollow portion 13A and can be raised and lowered within portion 13A in order to raise and lower the height above the ground of top portion 12.

Figure 1:
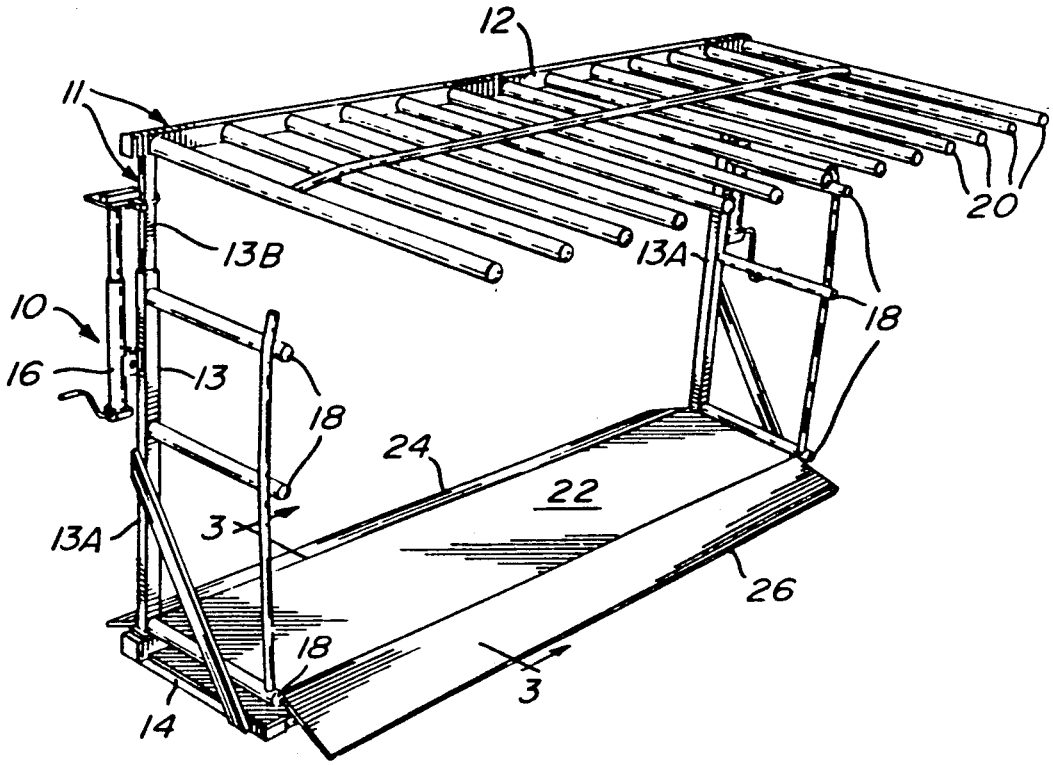
FIG. 1 is a perspective drawing of an apparatus of the present invention.

Frame 11 defines an entrance and stands on a base plate 14 which with side portions 13, acts as a support means to hold frame 11 perpendicular to the ground.

Side portions 13B may be raised or lowered by a rachet jack 16. Other means for raising and lowering side portions 13B include jacks or "rams" such as, for example, a hydraulic, screw or a hydraulic or air ram, which has been fitted to the two side portions 13A and 13B. The width of the apparatus can also be adjusted by similar devices, but which are not shown in this embodiment.

Along side portions 13 are a plurality of tines 18 which run perpendicular to and rearwardly of the entrance defined by frame 11. Along entrance member 12, as retaining means, in a plurality of tines 20 which act as an upper support frame, which tines also run perpendicular to and rearwardly of the opening defined by frame 11. Tines 18 extend 1 meter from the forward part of frame 11, and tines 20 extend 2 meters from frame 11.

At the bottom of frame 11, is located a solid skid plate 22 extending across the width of frame 11 and having a forward edge 24 and a rearward edge 26.

Figure 2:
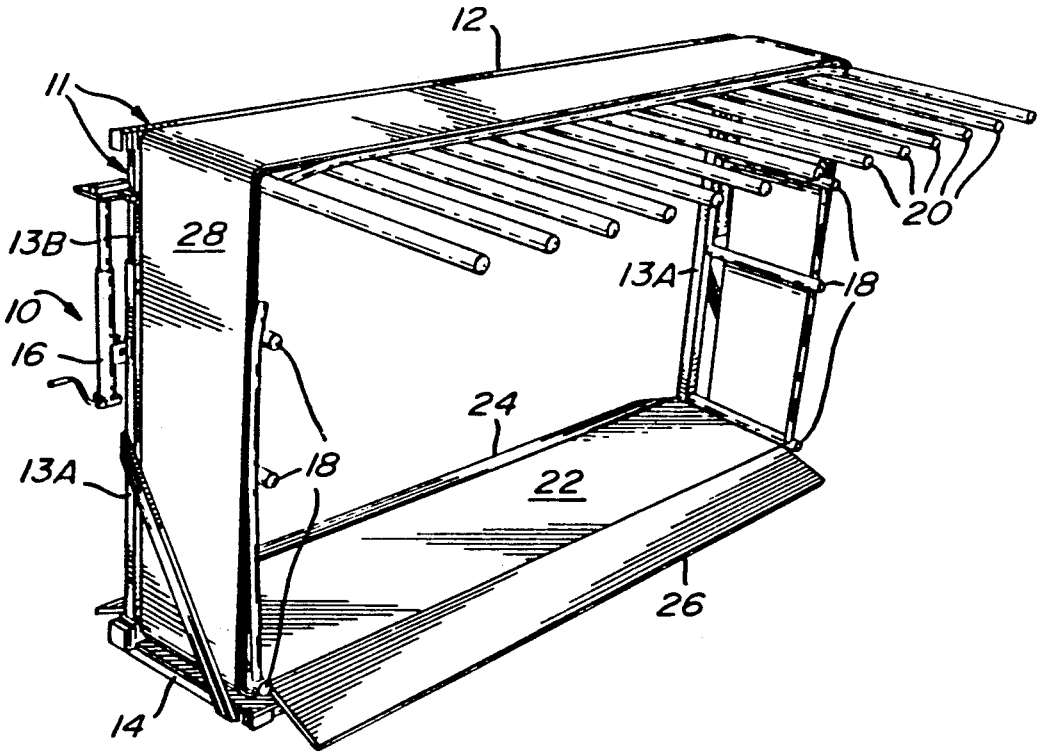
FIG. 2 is a perspective drawing of an apparatus as described in FIG. 1, which has been fitted with a store of tubular material.

In FIG. 2, apparatus 10 of FIG. 1 is shown, which has been fitted with a folded, concentrated store of a protective tubular material 28, which tubular material has a diameter of 3.7 meters (12 feet). Tubular material 28 has been fitted around the outside of tines 18 and 20 and passes under skid plate 22. When fully extended, tubular material 28 has a length of 30 meters (100 feet).

Side portion 13B can be lowered inside of side portion 13A to allow the fitting of tubular material 28 over tines 18 and 20. When tubular material 28 is in place, side portions 13B are raised using jacks 16 until tubular material 28 is held taut on tines 18 and 20.

Figure 3:
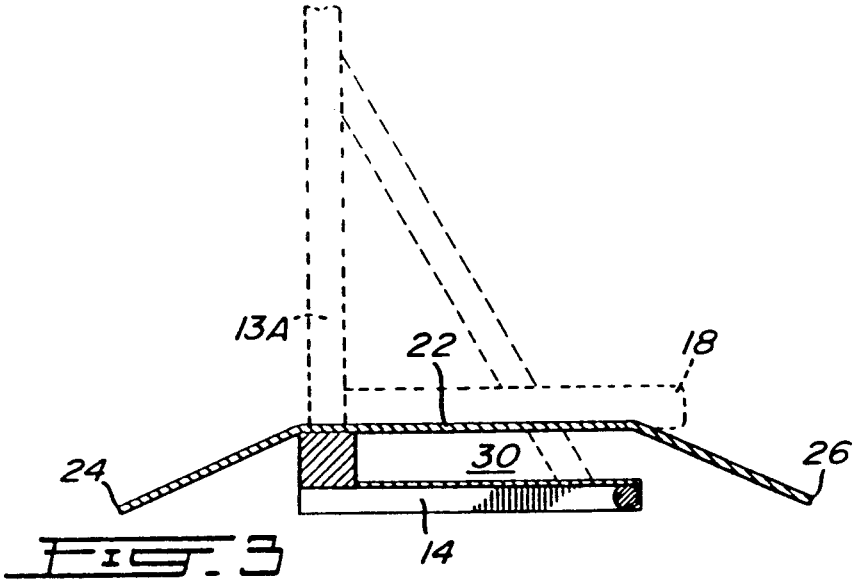
FIG. 3 is a cross-sectional view of the lower portion of the apparatus of FIG. 1, along the line 3—3.

Further details regarding skid plate 22 and the base of frame 11 can be seen in FIG. 3. Skid plate 22 is supported off of the ground by base plate 14 and forms a recess 30 under skid plate 22 in which the folded store of tubular material 28 may be placed. The forward edge 24 of skid plate 22 is located proximate to the ground, an dispositioned so as to be outside of the tubular sack formed by tubular material 28. Rearward edge 26 is also proximate to the ground and is positioned so as to be inside of the tubular sack formed by tubular material 28 The outline of a portion of one side of apparatus 10 can also be seen in broken lines in FIG. 3.

Figure 4:
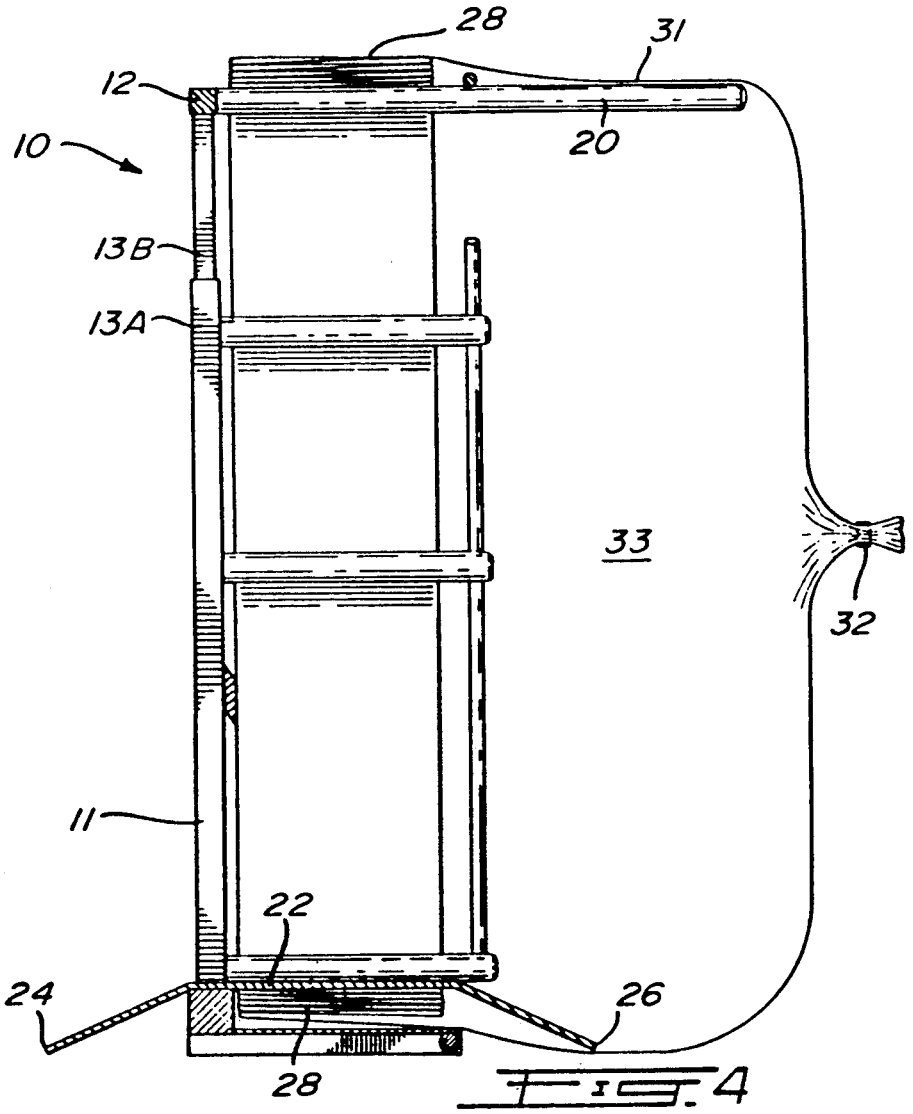
FIG. 4 is a partial cross-sectional view of the frame and tubular material after a beginning portion of the tubular material has been released from the apparatus.

With reference to FIG. 4, once fitted with tubular material 28, a beginning portion 31 of 5 to 7 meters in length of tubular material 28 is pulled from the concentrated store of tubular material 28 held on tines 28 and 20. The beginning portion 31 is tied together into a knot 32 and thus creates an enclosed pocket 33 within tubular material 28. Forward edge 24 of skid plate 22 is outside of pocket 33 while rearward edge 26 is positioned inside of pocket 33.

Tines 20 on horizontal member 12 of frame 11 extend into pocket 33 and prevent beginning portion 31 of tubular material 28 from falling into pocket 33.

Figure 5:
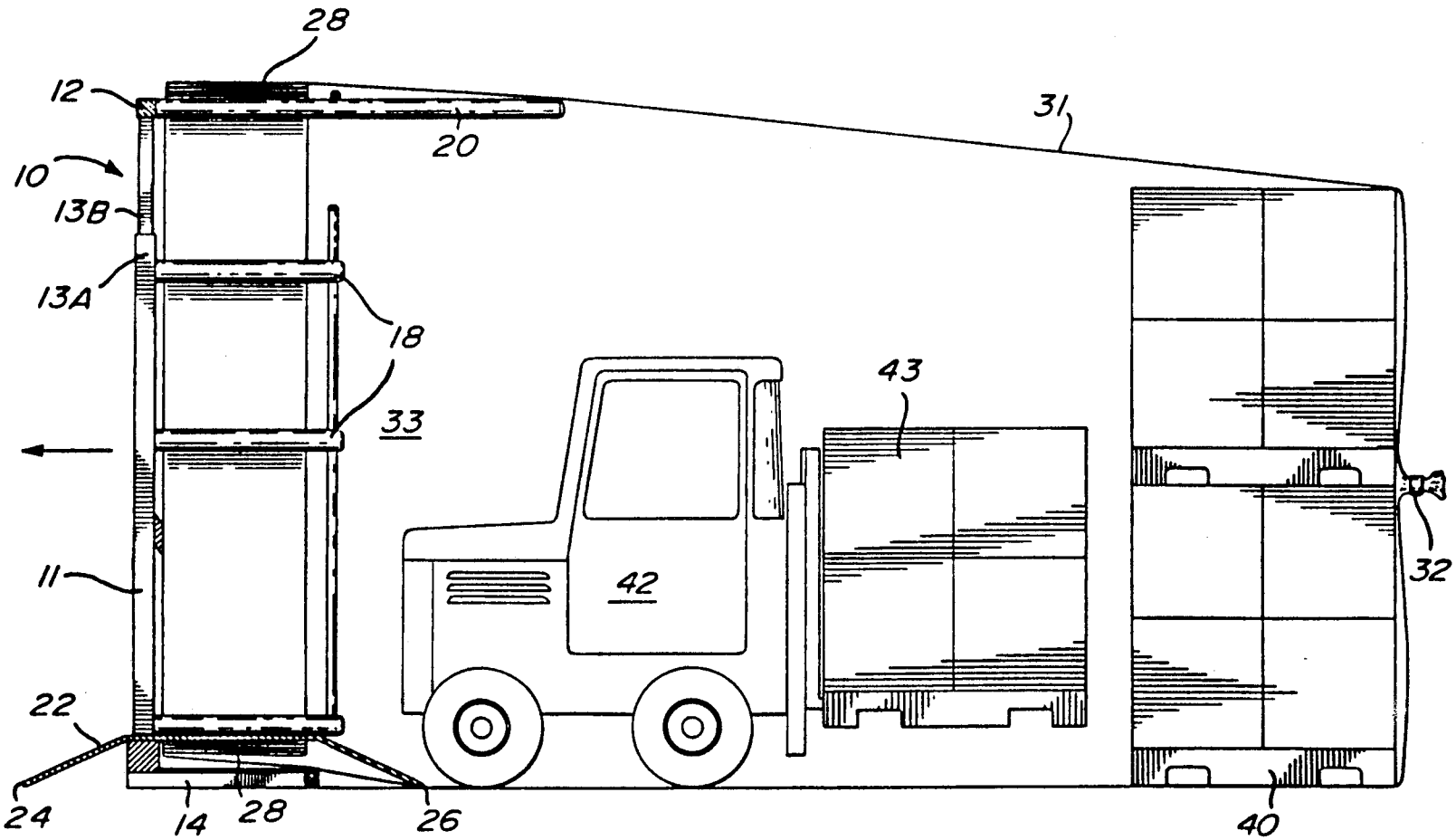
FIG. 5 is a partial cross-sectional view of the frame and tubular material shown in FIG. 3 wherein palleted materials have been placed within the tubular material.

In FIG. 5, the same apparatus 10, fitted with tubular material 28, is shown as in FIG. 4 wherein a first row of palleted goods 40 has been placed within pocket 33. A fork-lift 42 is shown which has been driven into pocket 33 and carries a pallet of goods 43. Pocket 33 is held open by tines 20 and the first row of palleted goods 40. Due to the length of tines 20, pocket 33 is larger than the pocket formed in the devices of the prior art, and thus, fork-lift 42 is able to drive into pocket 33, over skid plate 22, without interference from the beginning portion 31 of tubular material 28.

Figure 6:
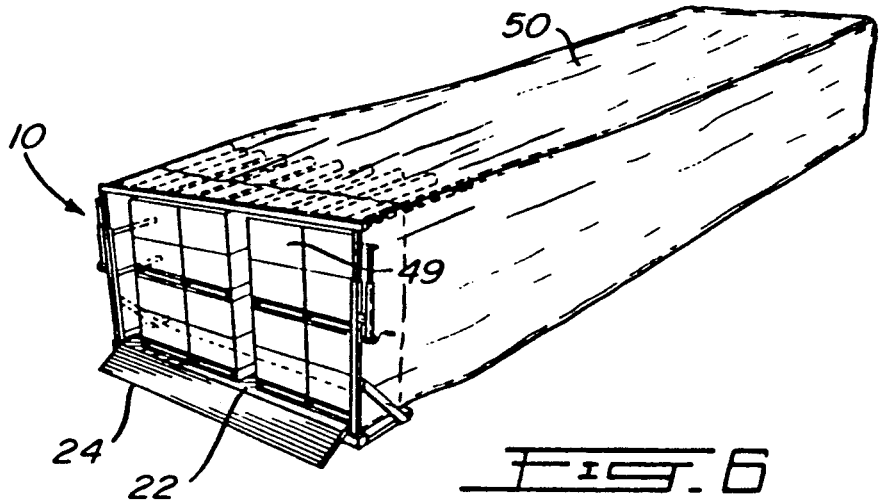
FIG. 6 is a perspective drawing of a filled sack.

In FIG. 6, an almost completely filled storage sack 50 is shown wherein most of concentrated store of tubular material 28 has been withdrawn from apparatus 10. A number of rows of palleted goods have been placed within sack 50, with only the last row 49 placed in sack 50 being visable. At this point, the fork-lift is used to raise apparatus 10 and pull apparatus 10 forward. The last length of tubular material 28 falls free from apparatus 10 and apparatus 10 can be removed. The free end of tubular material 28 is tied together in order to enclose the palleted goods completely within sack 50.

An alternative embodiment is shown with reference to FIGS. 7-12.

Figure 7:
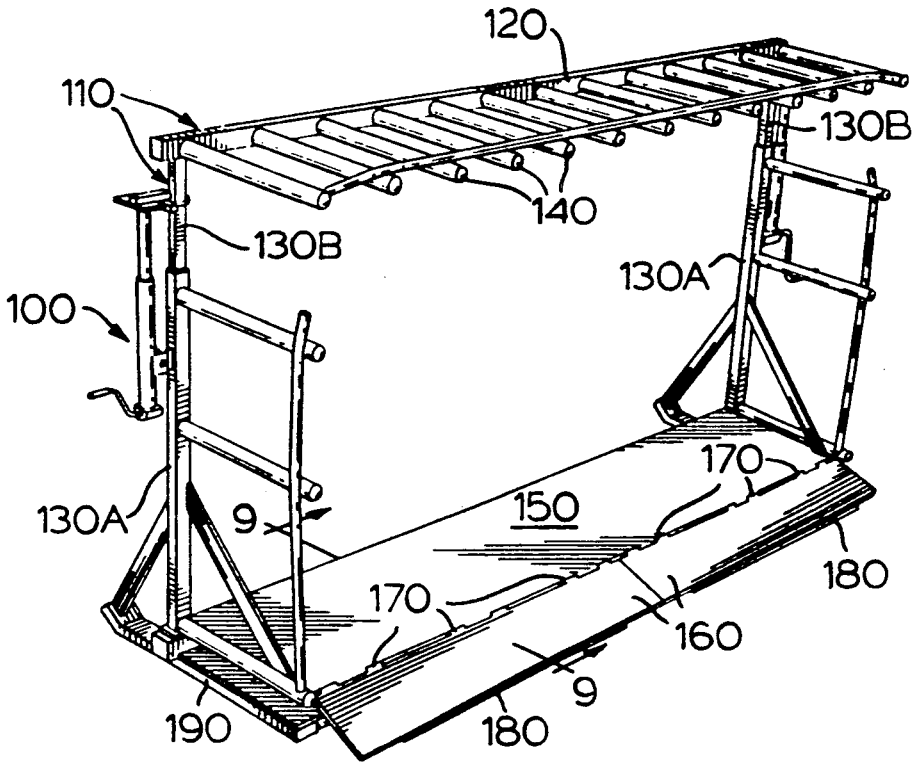
FIG. 7 is a perspective drawing of an alternative embodiment of the apparatus of the present invention.

In FIG. 7, an apparatus 100 according to the present invention is shown having a generally rectangular frame 110 with a top portion 120 and side portions 130. Side portion 130 each comprise two parts 130A and 130B. Side portion 130B fits into the top of hollow portion 130A and can be raised and lowered within portion 130A in order to raise and lower the height above the ground of top portion 120. Along both side portions 130 and top portion 120 are a plurality of tines 140 which run perpendicular to the opening defined by the top 120 and side 130 portions of frame 110.

At the bottom of frame 110, is located a solid skid plate 150. Attached to rearward edge of skid plate 150 are the front edges of movable plates 160. Movable plates 160 are attached to skid plate 150 by hinges 170. At the lower or rearward edge of movable plates 160 are rollers 180.

At the bottom of apparatus 100 the frame is supported off the ground by skid bars 190.

Figure 8:
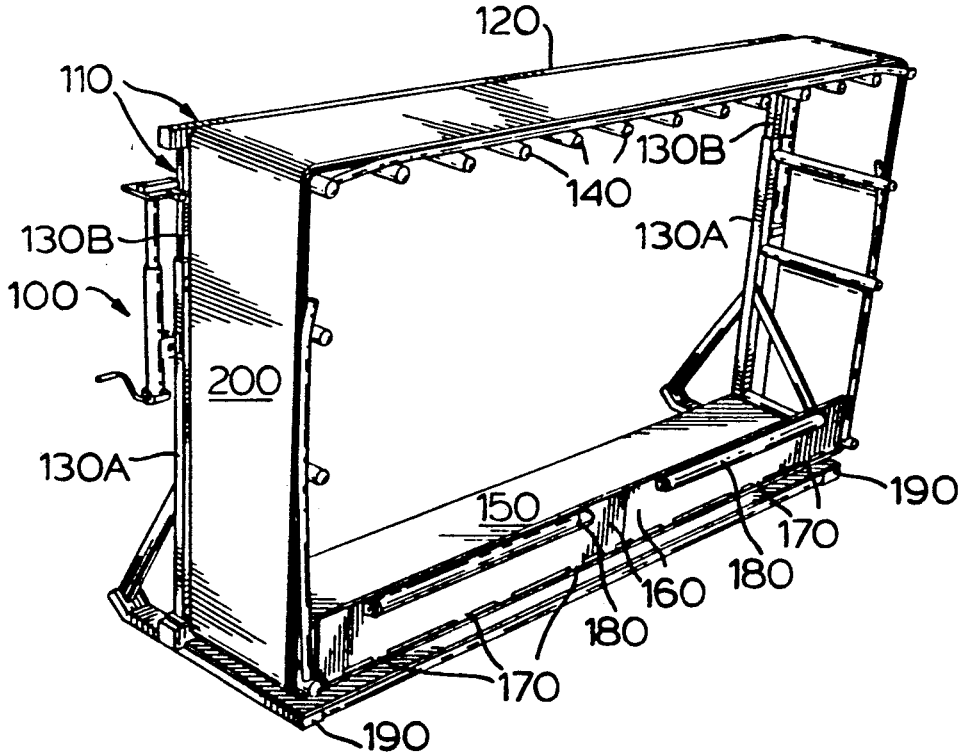
FIG. 8 is a perspective drawing of the alternative embodiment of the apparatus of the present invention which has been fitted with a tubular sack.

In FIG. 8, the same apparatus 100 of FIG. 7 is shown, which apparatus has been fitted with a folded, concentrated store of a protective tubular material 200, which tubular material has a diameter of 3.7 meters (12 feet). Tubular material 200 has been fitted around the outside of tines 140 and passes under skid plate 150. It can also be seen that movable plate 160 has been moved to an upright position in order to facilitate the placing of tubular material 200 under skid plate 150. When fully extended, tubular material 200 has a length of 30 meters (100 feet).

Side portion 130B can be lowered inside of side portion 130A during the fitting of tubular material 200 over tines 140. When tubular material 200 is in place, side portions 130B are raised until tubular material 200 is held taut on tines 140.

The side portions 130A and 130B are temporarily bolted into place until filling of the tubular material is complete.

In an alternative arrangement, side portion 130B can be raised and lowered by jacks or "rams" such as for example, a hydraulic, screw or ratchet jack or a hydraulic or air ram which has been fitted to the two side portions 130A and 130B. The width of the apparatus can also be adjusted by similar devices.

Figure 9:
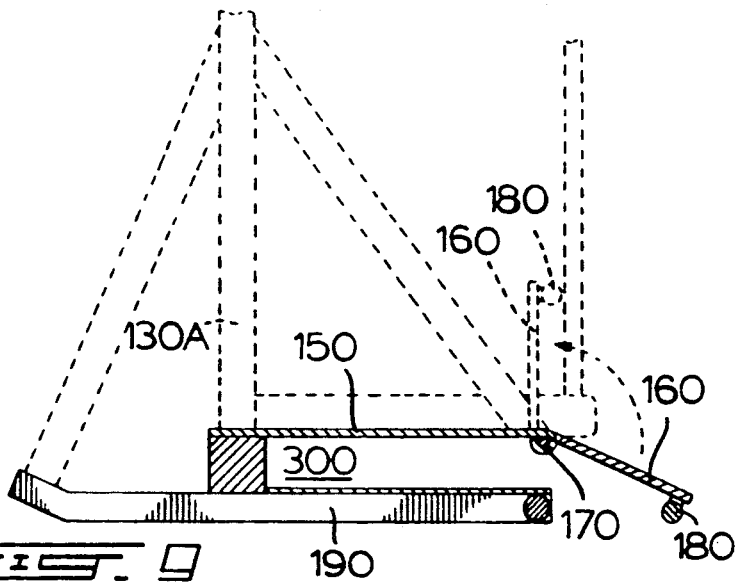
FIG. 9 is a cross-sectional view of the lower portion of the apparatus along the line 9—9 in FIG. 7.

Further details regarding skid plate 150 and movable plate 160 can be seen in FIG. 9. Skid plate 150 is supported off of the ground by skid bar 190 and forms a recess 300 under skid plate 150 in which the folded store of tubular material 200 may be placed. At the rearward edge of movable plate 160, are rollers 180. Movable plate 160 is shown, in continuous lines, in its lowered position, and is also shown in broken lines in its raised position. When in the raised position, tubular material 200 may be easily placed within recess 300 under the skid plate. The outline of a portion of one side of apparatus 100 can also be seen in broken lines in FIG. 9.

Figure 10:
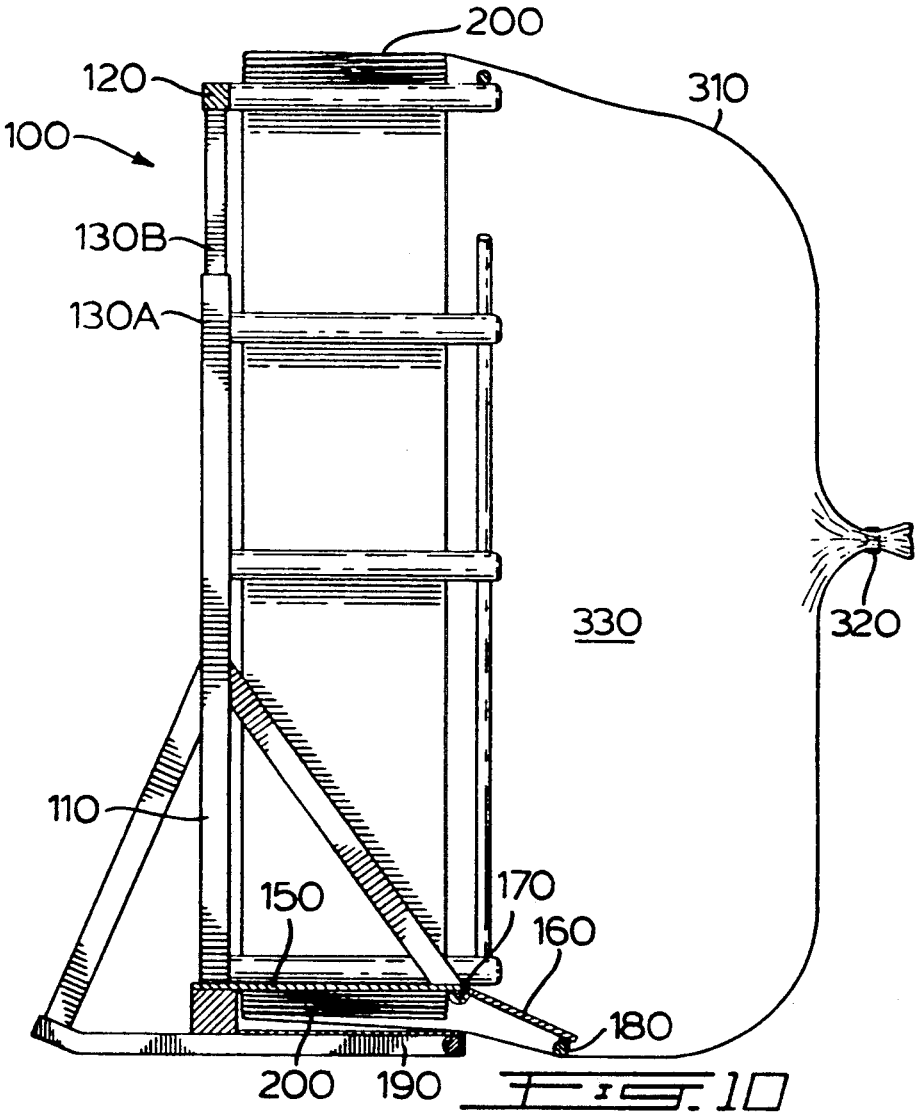
FIG. 10 is a partial cross-sectional view of the frame and tubular sack after a beginning portion of the tubular material has been removed from the apparatus.

Once fitted with tubular material 200, a beginning portion 310 of tubular material 200 which is 3 to 5 meters in length is pulled from the concentrated store of tubular material 200 held on tines 140. This is best seen in FIG. 10. The beginning end 310 is tied together 320 which creates an enclosed pocket 330 within tubular material 200. Movable plates 160 have been lowered so that rollers 180 rest on tubular material 200. It is to be noted that tubular material 200 is below skid plate 150 and is held off the ground since a portion of skid bar 190 is positioned so as to raise frame 110 off of the ground.

Side portions 130A and 130B may also be seen in FIG. 10.

Figure 11:
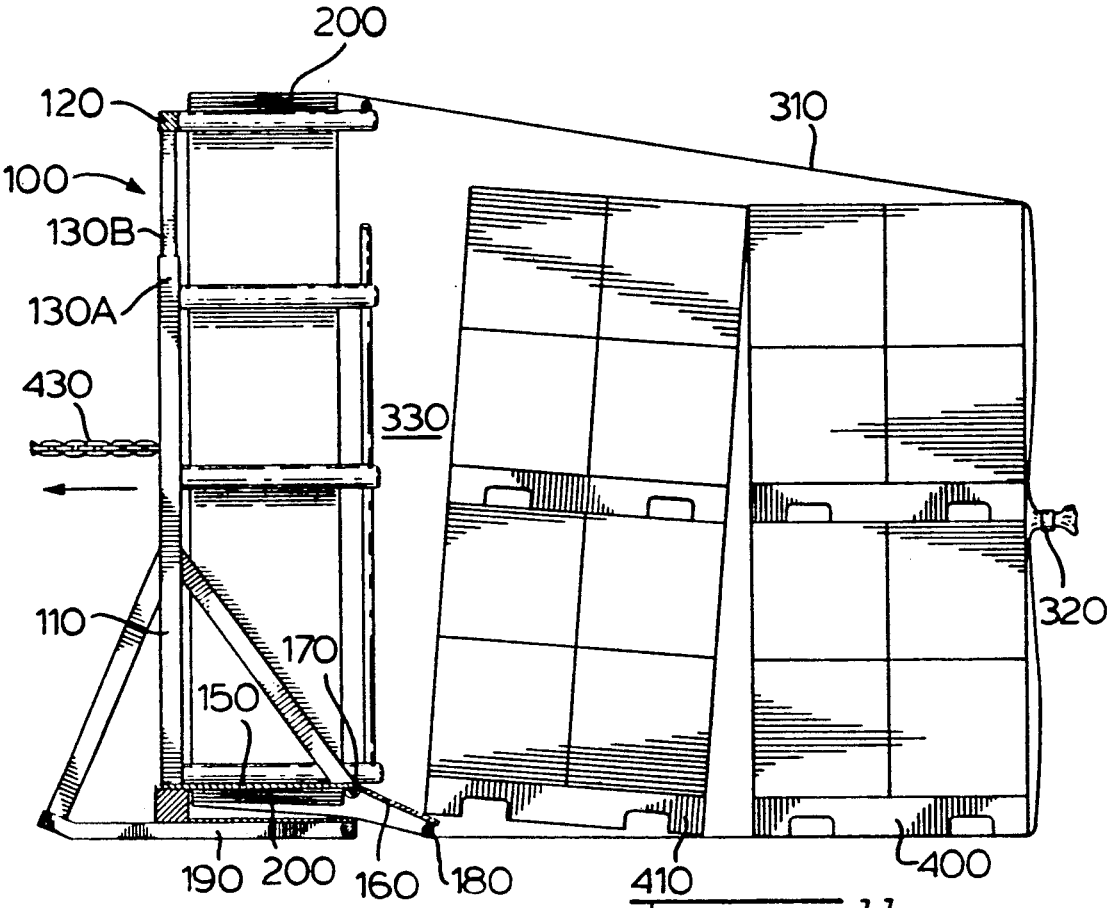
FIG. 11 is a partial cross-sectional view of the frame and tubular material shown in FIG. 9 wherein two rows of palleted material have been placed within the tubular material.

In FIG. 11, the same apparatus 100, fitted with tubular material 200, as shown in FIG. 10 is shown wherein a first row of palleted goods 400 has been placed within recessed pocket 330. A second row of palleted goods 410 has also been placed within the recessed pocket 330 and rests on movable plate 160. A fork-lift (not shown) has been temporarily chained to frame apparatus 100 by chains 430, and pulls the apparatus forward in the direction of the arrow. As the apparatus moves, additional tubular material 200 slides off tines 140 and the size of recessed pocket 330 is increased. Movable plates 160 roll along the bottom portion of tubular material 200 via rollers 180, and, thus cause the second row of palleted goods 410 to slide off movable plates 160.

Figure 12:
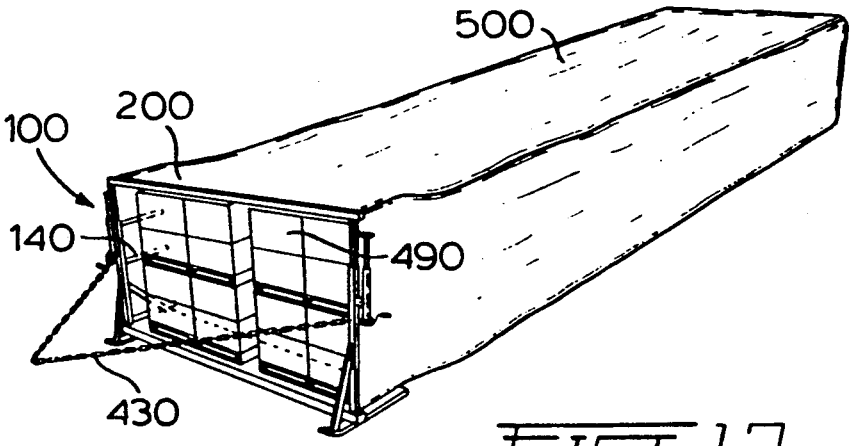
FIG. 12 is a perspective drawing of a filled sack.

In FIG. 12, an almost completely filled storage sack 500 is shown wherein most of concentrated store of tubular material 200 has been withdrawn from tines 140. A number of rows of palleted goods have been placed within sack 500, with only the last row 490 put in sack 500 being visable. At this point, the fork-lift is again temporarily attached to apparatus 100 by chains 430 in order to pull apparatus 100 forward. The last length of tubular material 200 falls free from tines 140, and the apparatus 100 can be removed. The free end of tubular material 200 is tied together in order to enclose the palleted goods completely within sack 500.

What we claim is:

1. An apparatus for use in storing goods on a pallet within a protective sack made of a flexible tubular material with a fork-lift truck carrying said goods, which apparatus comprises:

a rectangular frame for holding said sack therearound, defining an entrance for full entry therethrough of a fork-lift truck to enable said truck to deposit said pallet within said protective sack, which frame comprising a horizontal entrance member having a first end and a second end, said entrance having a front and a rear;

vertical support means at each of said first and second ends holding said entrance member essentially perpendicular to the ground;

a base co-operating with said support means to provide stability to said frame;

said support means comprising a hollow member and a rigid member in telescopic engagement therewith to allow of relative vertical movement of said rigid member within said hollow member;

jacking means cooperable with said support means to effect said vertical movement of said rigid member within said hollow member;

a plurality of horizontal tines between said first and second ends and extending rearwardly of said entrance and of a length to support a folded store of said tubular material and hold a sufficient length of rearwardly dispensed material open and navigatable to said fork-lift truck to enable entry of the entire said fork-lift truck within a latter part of said dispensed material; and a skid plate for supporting said fork-lift truck driving thereover, above and extending essentially across said base and said frame at a lower part, and having a forward edge adjacent the front of said entrance and a rearward edge adjacent the rear of said entrance, which forward and rearward edges are both proximate to the ground, and which skid plate covers a portion of said folded store of said flexible material and protects said folded store from said fork-lift truck driving thereover.

* * * * *